US005550652A

United States Patent [19]

Park

[11] Patent Number: 5,550,652

[45] Date of Patent: Aug. 27, 1996

[54] AUTOMATIC DOCUMENT FEEDER FOR A FACSIMILE MACHINE

[75] Inventor: Kyung S. Park, Seoul, Rep. of Korea

[73] Assignee: Goldstar Co., Ltd., Seoul, Rep. of Korea

[21] Appl. No.: 260,291

[22] Filed: Jun. 14, 1994

[30] Foreign Application Priority Data

Jun. 15, 1993 [KR] Rep. of Korea ..... 93/10452

[51] Int. Cl.[6] ..... H04N 1/12

[52] U.S. Cl. ..... 358/498; 358/496; 271/117

[58] Field of Search ..... 358/400, 496, 358/498; 355/308, 309, 318; 271/110, 117, 126, 119, 121; H04N 1/12

[56] References Cited

U.S. PATENT DOCUMENTS

| | | | |
|---|---|---|---|
| 4,750,726 | 6/1988 | Looney . | |
| 4,866,531 | 9/1989 | Kabori et al. | 358/400 |
| 5,120,042 | 6/1992 | Goto et al. | 271/121 |
| 5,155,603 | 10/1992 | Seok-Jae | 358/498 |
| 5,358,230 | 10/1994 | Ikemori et al. | 271/119 |
| 5,369,509 | 11/1994 | Ko | 358/498 |
| 5,422,732 | 6/1995 | Takayanagi | 358/400 |

*Primary Examiner*—Kim Yen Vu

*Attorney, Agent, or Firm*—Finnegan, Henderson, Farabow, Garrett & Dunner, L.L.P.

[57] ABSTRACT

An automatic document feeder for facsimiles for reliably feeding at least 30 sheets of documents into a facsimile one by one without misfeeding is disclosed. The document feeder comprises an ADF (automatic document feeding) roller for feeding documents. A rotating shaft is coupled to the ADF roller such that it is run idle. At least one cam roller is mounted on the rotating shaft for feeding a misfed document. A drive motor for generation of document feeding force is coupled to a drive gear so as to rotate this drive gear. A power transmission unit transmits the rotational force of the drive gear to both the ADF roller and the cam roller so as to rotate these rollers. The power transmitting unit comprises a driven gear gearing into the drive gear and mounted on the rotating shaft such that it is run idle. A driven gear flange is formed on a side of the driven gear. A bush is fixed to the rotating shaft. One side of the bush comes into contact with the driven gear flange while the other side of the bush comes into contact with an ADF roller flange. A clutch member is mounted on all of the outer surfaces of the driven gear flange, the bush and the ADF roller flange for integrating them into a single body during a document feeding operation.

4 Claims, 2 Drawing Sheets

AUTOMATIC DOCUMENT FEEDER FOR A FACSIMILE MACHINE

BACKGROUND OF THE INVENTION

1. Field of the Invention

The present invention relates in general to automatic document feeders for facsimile machines and, more particularly, to an improved structure in such document feeders for reliably feeding at least 30 sheets of documents into a facsimile machine one by one without misfeeding.

2. Description of the Prior Art

With reference to FIG. 1, there is shown in a schematic view a typical facsimile machine in a data transmitting operation. In the data transmitting operation, a plurality of documents 1 printed with the data are laid on a document plate 2 of the facsimile machine. When operating the facsimile machine in this state, the lowest document 1 is first fed into the facsimile machine by rotation of an automatic document feeding (ADF) roller 3 cooperating with the frictional force of an ADF rubber 4. The lowest document fed into the facsimile machine is in turn nipped by a pair of feeding rollers 5 and runs in the facsimile machine with a predetermined interval between it and a later document.

In the above typical facsimile machine, the contact angle between the ADF roller 3 and the ADF rubber 4 is limited to a predetermined angle so that it requires additionally use of a document feeder or a device for feeding the documents 1 to the nip between the ADF roller 3 and the ADF rubber 4 of the facsimile machine one by one when data printed on at least 30 sheets of documents 1 are to be transmitted by the facsimile machine.

In the prior art, the document feeder for feeding at least 30 sheets of documents 1 to the nip between the ADF roller 3 and the ADF rubber 4 of the facsimile machine comprises a cam roller facing the ADF roller 3 and a drive motor for driving the cam roller. The drive motor drives the cam roller only when the documents 1 need feeding, thus to feed the documents to the nip between the ADF roller 3 and the ADF rubber 4 one by one in such a manner that the lowest document is first fed. However, with the additional cam roller and the cam roller drive motor, the above document feeder is increased in its production cost.

In order to combat this problem, there has been proposed another type of document feeder is which the cam roller is rotated by the rotational force of the ADF roller 3 as shown in FIG. 2. This document feeder comprises a drive gear 6 rotated by an outside drive force, a driven gear 8 gearing into the drive gear 6 and a first shaft 7 integrally coupled to the driven gear 8. The ADF roller 3 is fixed to a second shaft 9, which shaft 9 is placed such that it is close to the first shaft 7. A spring 10 is fitted over both the first and second shafts 7 and 9 and functions as an one way clutch. The document feeder further includes a third shaft 11, which is parallel with the second shaft 9, and a timing belt 12 wrapped about the second and third shafts 9 and 11 for making these shafts 9 and 11 cooperating with each other. A pair of cam rollers 13 is fixed to the third shaft 11.

In operation of the above document feeder of FIG. 2, the drive gear 6 is rotated by the outside drive force or the rotational force of an additional drive motor (not shown) so that the driven gear 8 gearing into the drive gear 6 is rotated. The rotational motion of the driven gear causes the first shaft 7 to be rotated. The rotational motions of both the driven gear 8 and the first shaft 7 cause the spring 10 fitted over the first and second shafts 7 and 9 to be tightened due to the frictional force of the outer surfaces of the first and second shafts 7 and 9. The first and second shafts 7 and 9 are thus integrated into a single body and, as a result, the rotational force of the drive gear 6 is transmitted to the second shaft 9 through the first shaft 7. Here, the tightening of the spring 10 because of both the rotational motion of the drive gear 6 and the frictional force of the first shaft 7 is caused by the fact that there is provided a narrow gap of about 0.05–0.1 mm between the first and second shafts 7 and 9 and the spring 10.

When the ADF roller 3 is rotated by the rotational force of the second shaft 9, the lowest document 1 which has been nipped between the ADF roller 3 and the ADF rubber 4 is fed into the facsimile machine owing to the rotating frictional force of the ADF roller 3. When there is no document between the ADF roller 3 and the ADF rubber 4, the lowest document laid on the document plate is fed into the nip between the ADF roller 3 and the ADF rubber 4 owing to the rotational motion of the cam roller 13. Of course, the cam roller 13 is rotated by the rotational motion of the third shaft 11, which shaft 11 is applied with the rotational force from the second shaft 9 through the timing belt 12.

It has been noted that the above document feeder has an advantage in that it uses only one motor when it feeds at least 30 sheets of documents into the facsimile machine one by one by rotating the cam roller 13.

However, the above document feeder also has a disadvantage in that the cam roller 13 is mounted on the third shaft 11 which should cooperate with the second shaft 9 in addition to the timing belt 12. With the third shaft 11 and the timing belt 12, the above document feeder must be provided with a large number of elements. The structural complexity of the document feeder makes the production of the feeder a complex process.

SUMMARY OF THE INVENTION

It is, therefore, an object of the present invention to provide an automatic document feeder for a facsimile machine in which the aforementioned problems caused by the conventional document feeders can be overcome and which reliably feeds at least 30 sheets of documents into a facsimile machine one by one without misfeeding.

In order to accomplish the above object, an automatic document feeder for a facsimile machine in accordance with an embodiment of the present invention comprises an ADF (automatic document feeding) roller for feeding documents; a rotating shaft coupled to the ADF roller such that it is run idle; cam roller means for feeding a misfed document, the cam roller means being mounted on the rotating shaft; a drive gear coupled to the drive motor through a power transmission shaft; and power transmission means for transmitting the rotational force of the drive gear to both the ADF roller and the cam roller so as to rotate these rollers.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
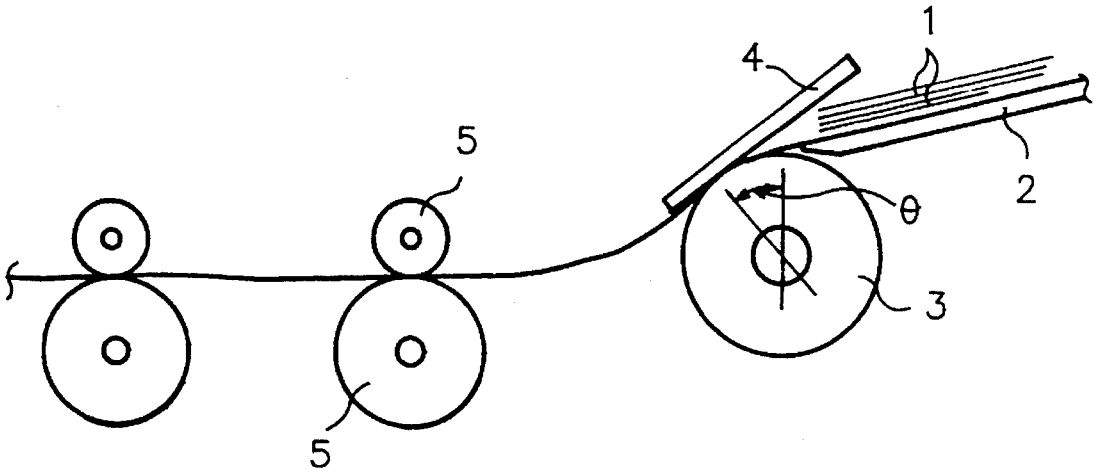
FIG. 1 PRIOR ART
FIG. 1 is a schematic view of a typical facsimile machine in a data transmitting operation.
Figure 2:
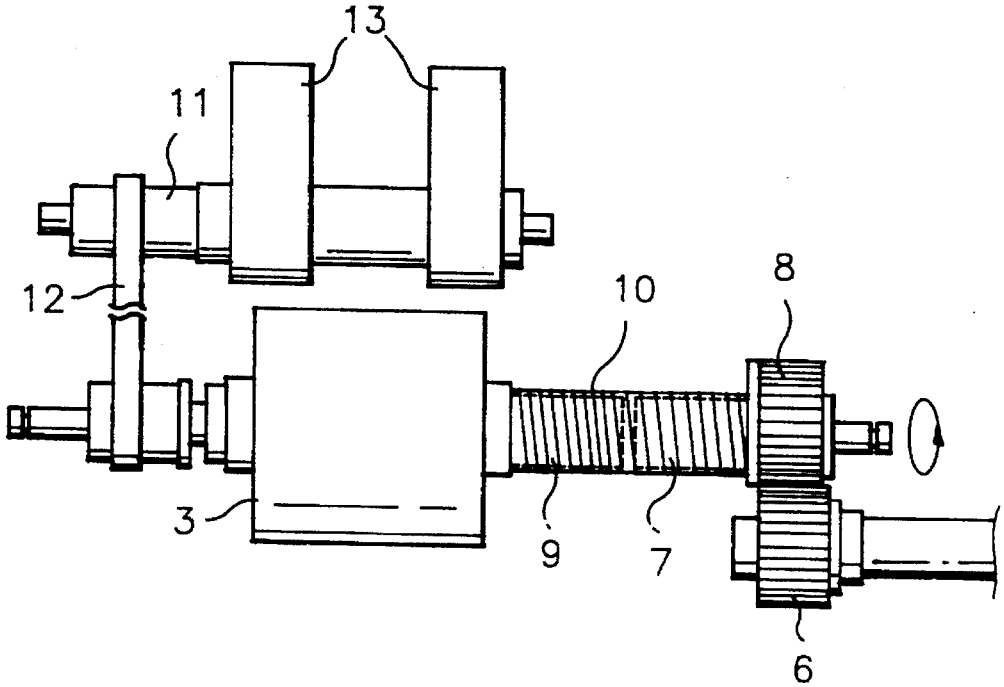
FIG. 2 PRIOR ART
FIG. 2 is a plan view of a conventional document feeder for a facsimile machine.

In the following description, those elements common to both the embodiment of this invention and the prior art embodiment of FIG. 1 and 2 will carry the same reference numerals.

Figure 3:
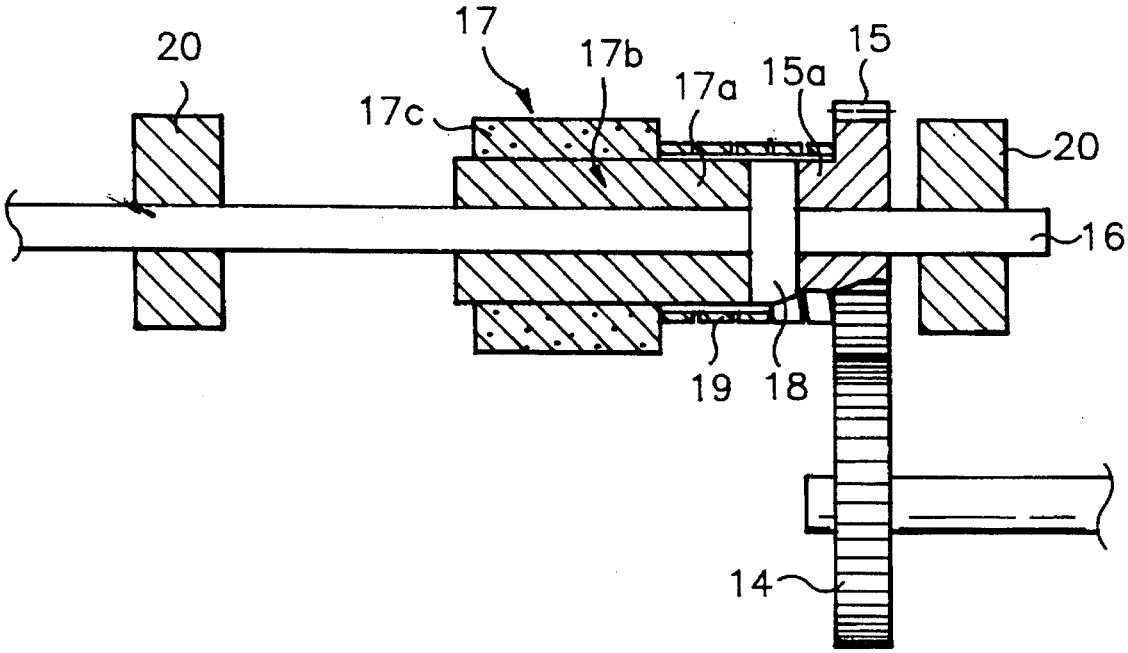
FIG. 3 a plan view of an automatic document feeder for a facsimile machine in accordance with an embodiment of the present invention.
Figure 4:
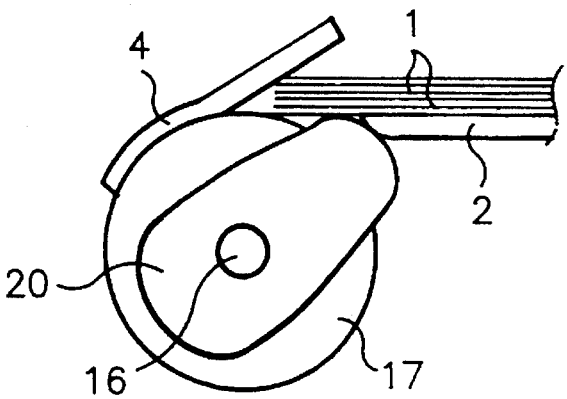
FIG. 4 is a side view of the document feeder of FIG. 3.

With reference to FIGS. 3 and 4, there is shown an automatic document feeder for a facsimile machine in accordance with an embodiment of the present invention. As best seen in FIG. 3, the document feeder of this invention comprises an ADF roller 17 for feeding the documents 1 printed with data to be transmitted by the facsimile machine. A rotating shaft 16 is coupled to the ADF roller 17 such that it can be run idle. The rotating shaft 16 supports at least one cam roller 20 thereon. This cam roller 20 is adapted to feed a misfed document and is fixedly mounted on the shaft 16. The output shaft of a drive motor (not shown) is fixedly coupled to a drive gear 14. The document feeder further comprises power transmission means for transmitting the rotational force of the drive gear 14 to both the ADF roller 17 and the cam roller 20 so as to rotate these rollers 17 and 20.

The ADF roller 17 comprises a cylindrical member **17*b* having an ADF roller flange 17*a*. A rubber member 17*c* is fitted over the cylindrical member 17*b* and directly contacts with the document 1 when feeding the document into the facsimile machine. Here, it is preferred to produce the cylindrical member 17*b* using a plastic material causing less friction between the member 17*b* and the rotating shaft 16**.

In addition, it is preferred to place two cam rollers 20 on opposed ends of the rotating shaft 16 such that the rollers 20 are included within a predetermined width of document 1. In this case, a desired stable document feeding result is achieved.

The power transmitting means comprises a driven gear 15 which gears into the drive gear 14 and is mounted on the rotating shaft 16 such that it can be run idle. This driven gear 15 has a flange **15*a* which is formed on a side of the driven gear 15. A bush 18 is fixed to the rotating shaft 16. One side of the bush 18 comes into contact with the flange 15*a* of the driven gear 15 while the other side of the bush 18 comes into contact with a flange 17*a* of the ADF roller 17. The power transmitting means further includes a clutch member which is mounted on all of the outer surfaces of the driven gear flange 15*a*, the bush 18 and the ADF roller flange 17*a* for integrating them into a single body during a document feeding operation. The above clutch member preferably comprises a coiled plate spring 19 which is fitted over all of the outer surfaces of the driven gear flange 15*a*, the bush 18 and the ADF roller flange 17*a* in such a manner that it is tightened such as by frictional force of the driven gear flange 15*a***.

The operational effect of the above automatic document feeder will be given hereinbelow.

When starting the facsimile machine by operating a start button (not shown) while laying the documents 1, printed with data to be transmitted by the facsimile machine, on a document plate, the rotational force of the drive motor (not shown) is transmitted to the drive gear 14 so as to rotate this gear 14. At the same time of rotation of the drive gear 14, the driven gear 15 gearing into the drive gear 14 is rotated idle in a direction of tightening the coil plate spring 19.

When the driven gear 15 is rotated idle in the direction of tightening the coil plate spring 19 as described above, the coiled plate spring 19 tightens all of the driven gear flange **15*a*, the bush 18 and the ADF roller flange 17*a*. The driven gear flange 15*a*, the bush 18 and the ADF roller flange 17*a* are, therefore, integrated into a single body and rotated along with the driven gear 15** at the same time.

As the rotating shaft 16 is rotated along with the driven gear 15, both the ADF roller 17 running idle on the rotating shaft 16 and the cam roller 20 fixed to the rotating shaft 16 are rotated in the same direction as the rotational direction of the driven gear 15. Thus, the lowest document 1 which has been fed between the ADF roller 17 and the ADF rubber 4 is fed into the facsimile machine by the frictional force of the ADF roller 17. When there is no document between the ADF roller 17 and the ADF rubber 4, the lowest document laid on the document plate is fed between the ADF roller 17 and the ADF rubber 4 owing to the rotational motion of the cam roller 20.

The above automatic document feeder has an advantage in that it uses only one motor when it feeds at least 30 sheets of documents into the facsimile machine one by one by rotating a cam roller.

Another advantage of this invention is resided in that the cam roller is not mounted on an additional shaft but mounted on a rotating shaft on which an ADF roller is mounted. In this regard, the above document feeder is substantially simple in its structure. This makes the feeder production a simple process.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic document feeder for a facsimile machine comprising:

a rotating shaft for transmitting drive force to feed documents;

an ADF (automatic document feeding) roller coupled to said rotating shaft to frictionally feed the documents;

cam roller means for receiving and feeding the documents, said cam roller means being directly mounted on said rotating shaft coaxially with said ADF roller;

a drive gear coupled to a drive motor generating the drive force through a power transmission shaft; and power transmission means for selectively controlling the transmission of the drive force of said drive gear to said ADF roller and said cam roller so as to rotate these rollers, wherein said power transmission means includes a single clutch member operatively connected to both said ADF roller and said cam roller for selectively controlling the transmission of the drive force.

2. The automatic document feeder according to claim 1, wherein said power transmission means comprises:

a driven gear in mesh with said drive gear and mounted on said rotating shaft;

a driven gear flange formed on a side of said driven gear;

a bush fixed to said rotating shaft, one side of said bush coming into contact with said driven gear flange; and an ADF roller flange coming into contact with the other side of said bush;

wherein said single clutch member is mounted on said driven gear flange, said bush and said ADF roller flange for integrating them into a single body during a document feeding operation.

3. The automatic document feeder according to claim 2, wherein said clutch member is a coiled plate spring fitted over said driven gear flange, said bush and said ADF roller flange in such a manner that it is tightened by frictional force of said driven gear flange.

4. The automatic document feeder according to claim 1, wherein said ADF roller comprises:

a cylindrical member having an ADF roller flange; and a rubber member fitted over said cylindrical member to directly contact the documents when feeding said documents into the facsimile machine.

* * * * *